US007558492B2

(12) United States Patent
Aoki

(10) Patent No.: US 7,558,492 B2
(45) Date of Patent: Jul. 7, 2009

(54) IMAGE FORMING APPARATUS AND IMAGE FORMING METHOD

(75) Inventor: Masaru Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 11/459,723

(22) Filed: Jul. 25, 2006

(65) Prior Publication Data

US 2007/0025745 A1 Feb. 1, 2007

(30) Foreign Application Priority Data

Jul. 29, 2005 (JP) ..... 2005-221589

(51) Int. Cl.
*G03G 15/00* (2006.01)

(52) U.S. Cl. ..... 399/16; 399/45; 399/388; 399/389

(58) Field of Classification Search ..... 399/16
See application file for complete search history.

(56) References Cited

U.S. PATENT DOCUMENTS 5,510,888 A * 4/1996 Kuge ..... 399/372
6,668,144 B2 12/2003 Maruyama ..... 399/45
7,149,441 B2 12/2006 Akita et al. ..... 399/45
2003/0194252 A1 10/2003 Nakamori ..... 399/389
2004/0146310 A1* 7/2004 Ohta et al. ..... 399/45
2006/0029425 A1* 2/2006 Tomatsu ..... 399/125

FOREIGN PATENT DOCUMENTS

JP 01231735 A * 9/1989
JP 06315065 A * 11/1994
JP 2002-182518 6/2002
JP 2003-302885 10/2003

* cited by examiner

*Primary Examiner*—Daniel J Colilla
*Assistant Examiner*—Allister Primo
(74) *Attorney, Agent, or Firm*—Fitzpatrick, Cella, Harper & Scinto

(57) ABSTRACT

In an image forming apparatus identifying recording materials to decide printing conditions, information concerning the type of the recording materials identified by a recording material identification unit is stored for each paper feed port. In a subsequent print job to be printed, the use of the information having been stored in advance makes it possible to omit the recording material identification process for the subsequent recording materials. This stored information includes individual information for each recording material and a determined value obtained from a plurality of a plurality of pieces of individual information. Once the determined value is set, the determined value is used thereafter. These pieces of stored individual information and the determined value are initialized when a change of paper or the like is detected at the paper feed port corresponding to the value and to the information.

7 Claims, 15 Drawing Sheets

RECORDING PAPER A

RECORDING PAPER B

RECORDING PAPER C

RECORDING PAPER A

RECORDING PAPER B

RECORDING PAPER C

FIG.15A

SET PRESCRIBED NUMBER = 5

DETECT ○

NOT DETECT —

α: DETECTED RESULT OF FIRST RECORDING MATERIAL

β: AVERAGED RESULT FOR FIVE RECORDING MATERIALS

CASE WHERE FIRST JOB INCLUDES NOT LESS THAN PRESCRIBED NUMBER OF PAGES

| JOB | 1 | | | | | | 2 | |
|---|---|---|---|---|---|---|---|---|
| NUMBER OF PRINTED PAGES FROM START | 1 | 2 | 3 | 4 | 5 | 6 | 7 | 8 |
| DETECTION | ○ | ○ | ○ | ○ | ○ | — | — | — |
| PAPER TYPE STATUS | α | α | α | α | α | α | β | β |

↑ β IS DETERMINED

FIG.15B

CASE WHERE FIRST JOB INCLUDES LESS THAN PRESCRIBED NUMBER OF PAGES

| JOB | 1 | | | 2 | | | | 3 |
|---|---|---|---|---|---|---|---|---|
| NUMBER OF PRINTED PAGES FROM START | 1 | 2 | 3 | 4 | 5 | 6 | 7 | 8 |
| DETECTION | ○ | ○ | ○ | ○ | ○ | — | — | — |
| PAPER TYPE STATUS | α | α | α | α | α | α | α | β |

↑ β IS DETERMINED

IMAGE FORMING APPARATUS AND IMAGE FORMING METHOD

BACKGROUND OF THE INVENTION

1. Field of the Invention

The present invention relates to an image forming apparatus including a detection unit detecting information concerning a recording material on which an image is formed, and relates to an image forming method thereof. More specifically, the present invention relates to an image forming apparatus, such as an ink jet printer, a copier, and a laser printer, which controls image forming conditions based on a result of detection performed by a detection unit detecting information concerning properties or a type of the recording material and perform an image forming operation according to the properties or the type of the recording material, and relates to an image forming method thereof.

2. Description of the Related Art

Image forming apparatuses which form an image based on an image signal are of various types such as an electrophotographic type and an ink jet type. In such an image forming apparatus, printing paper (recording materials) as printed media is varied, and there are media provided with various characteristics including size, transparency, gloss, and the like. Under the circumstances mentioned above, in order to obtain high image quality, it is necessary to perform image formation optimal to such a variety of media.

Generally, laser printers which are of the electrophotographic type are widely used as image forming apparatuses for business use, and ink-jet recording apparatuses are widely used as image forming apparatuses for general consumers. Such ink-jet recording apparatuses are quiet and can implement high speed recording because the ink-jet recording apparatuses employ non-contact method of printing to recording media. Moreover, the ink-jet recording apparatuses have advantages of high density recording, easy color printing, and the like.

A so-called electrophotographic type image forming apparatus, such as a copier and a laser printer, includes a latent image bearing body, a development unit, transfer means, and a fixation unit. The latent image bearing body bears a latent image. The development unit applies developer to the latent image bearing body to make the latent image visible as a developer image. The transfer means transfers the developer image formed by the development unit to a recording material conveyed in a predetermined direction. The fixation unit fixes the developer image to the recording material by heating and pressing the recording material having the developer image transferred by the transfer means under predetermined fixation process conditions.

The ink-jet recording apparatus generally includes a carriage on which a recording head and an ink tank are mounted, conveying means which conveys recording paper, and control means which controls these components. The ink-jet recording apparatus performs recording on the recording paper in such a manner that the carriage serially scans the recording paper in a direction (a main scanning direction) orthogonal to a conveying direction (a secondary scanning direction) with ink droplets being ejected from a plurality of outlets of the recording head while the recording paper is intermittently conveyed by a distance equal to recording width when the recording is not performed.

In such an image forming apparatus, heretofore, for example, the size and the type (hereafter, referred also to as paper type) of recording materials are set by a user through an operation panel provided for the body of the image forming apparatus. The aforementioned electrophotographic type image forming apparatus, for example, makes a control to change, according to such settings, development conditions, transfer conditions, or the fixation process conditions (for example, fixation temperature and conveying speed of recording materials passing through the fixation unit) or image processing and the like. Alternatively, the user sets a paper type from a host computer at printing, and the image forming apparatus thus makes the control to change the development, transfer, or fixation process conditions or the image processing according to the specified paper type.

The ink-jet type image forming apparatus controls amounts of ink discharged and performs color conversion processing according to the paper type and the like. Alternatively, the user sets a paper type through a host computer connected to the image forming apparatus at printing, and the image forming apparatus performs the above control and processing according to the specified paper type.

However, the user may forget to perform the aforementioned setting of the paper type, make a mistake in the setting, or mix a plurality of paper types. Accordingly, in the image forming apparatuses, especially in the image forming apparatuses for business use, automatic identification of the paper type has been increasingly implemented.

For example, as proposed in the Japanese Patent Application Laid-open Nos. 2002-182518 and 2003-302885, some of the image forming apparatuses identify the type of a recording material by a method of capturing an image of the surface of the recording material with a CMOS sensor to detect surface smoothness of the recording material, and variably control the development, transfer, or fixation conditions. Moreover, another apparatus has been proposed, in which a light emitting source is provided at a position opposite to the sensor which identifies the recording material, and transmitted light is detected in the identification of the recording material using transmitted light. The image forming apparatus has made a control using such a method of identifying the recording material so that the identification would be performed every time a recording material is fed (control as all the recording materials are to be identified) , or made another control so that the identification would be performed only for the first sheet of a print job and is not performed for the subsequent sheets.

However, the aforementioned conventional image forming apparatuses have the following problems. This recording material identification has a tendency to increase measurement time for an improvement in accuracy of the identification. It is necessary to identify various sheets existing on the market. However, if it is configured that all the recording materials are identified, every identification operation takes time, and the productivity is lowered. Moreover, in the case where the identification is performed only on the first sheet of each job and the subsequent sheets are processed using the identification result of the first sheet for control as described above, if the identification of the first sheet is wrong, all the subsequent sheets are subjected to control based on the wrong identification result.

SUMMARY OF THE INVENTION

Accordingly, the present invention proposes a configuration to perform identification of sheets with minimum influence thereof on the productivity or performances such as first print time and throughput. An object of the present invention is to provide an image forming apparatus which perform an optimal electrophotographic process, and which can provide a good image, with minimum reduction in accuracy of identifying paper type, and to provide an image forming method thereof.

In the first aspect of the present invention, there is provided an image forming apparatus, comprising: a paper feed section which includes an accommodation section accommodating recording materials; a recording material detecting section which detects the type of a plurality of the recording materials fed from the paper feed section; and a controller which determines the type of the recording materials based on the result of the detection of the type of the plurality of recording materials, the image forming apparatus wherein the controller makes a control to cause the recording material detecting section not to perform the detection on the recording material fed from the paper feed section after the type of the recording material is determined.

In the second aspect of the present invention, there is provided an image forming method, comprising the steps of: detecting information relating to a type of a recording material; determining a recording material type based on detection results of a plurality of the recording materials which results are obtained by detecting the type-related information on the plurality of recording materials fed from a paper feed section; and making a control to cause the detecting steps not to be performed after the recording material type is determined.

According to the aforementioned configuration, use of the identification result recorded and stored for each paper feed port enables the unit of performing recording material identification to perform printing control suitable for recording materials while maintaining the performance of the entire system.

Accordingly, the number of times of the recording material identification can be reduced compared to the case where the recording material identification is performed for every sheet of the recording material, and also compared to the case where the recording material identification is performed for every printing job.

Moreover, the identification accuracy can be increased compared to the case where the recording material identification is performed for only the first recording material of each print job.

Further features of the present invention will become apparent from the following description of exemplary embodiments (with reference to the attached drawings).

BRIEF DESCRIPTION OF THE DRAWINGS

FIGS. 15A and 15B are views showing settings of the printing conditions for each page of print jobs.

DESCRIPTION OF THE EMBODIMENTS

First Embodiment

Figure 12:
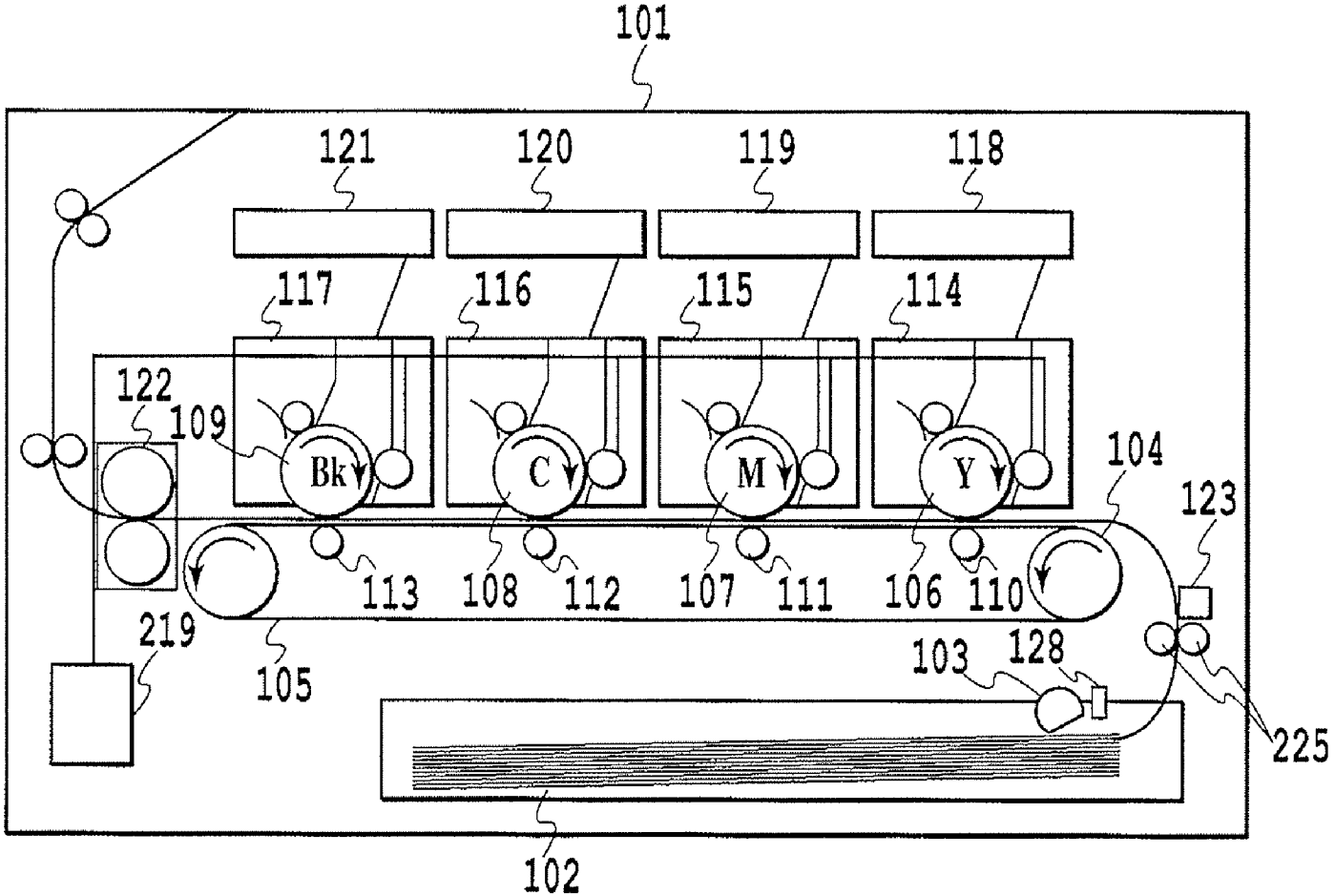
FIG. 12 is a view showing an example of the image forming apparatus to which the present invention is applicable.
Figure 13:
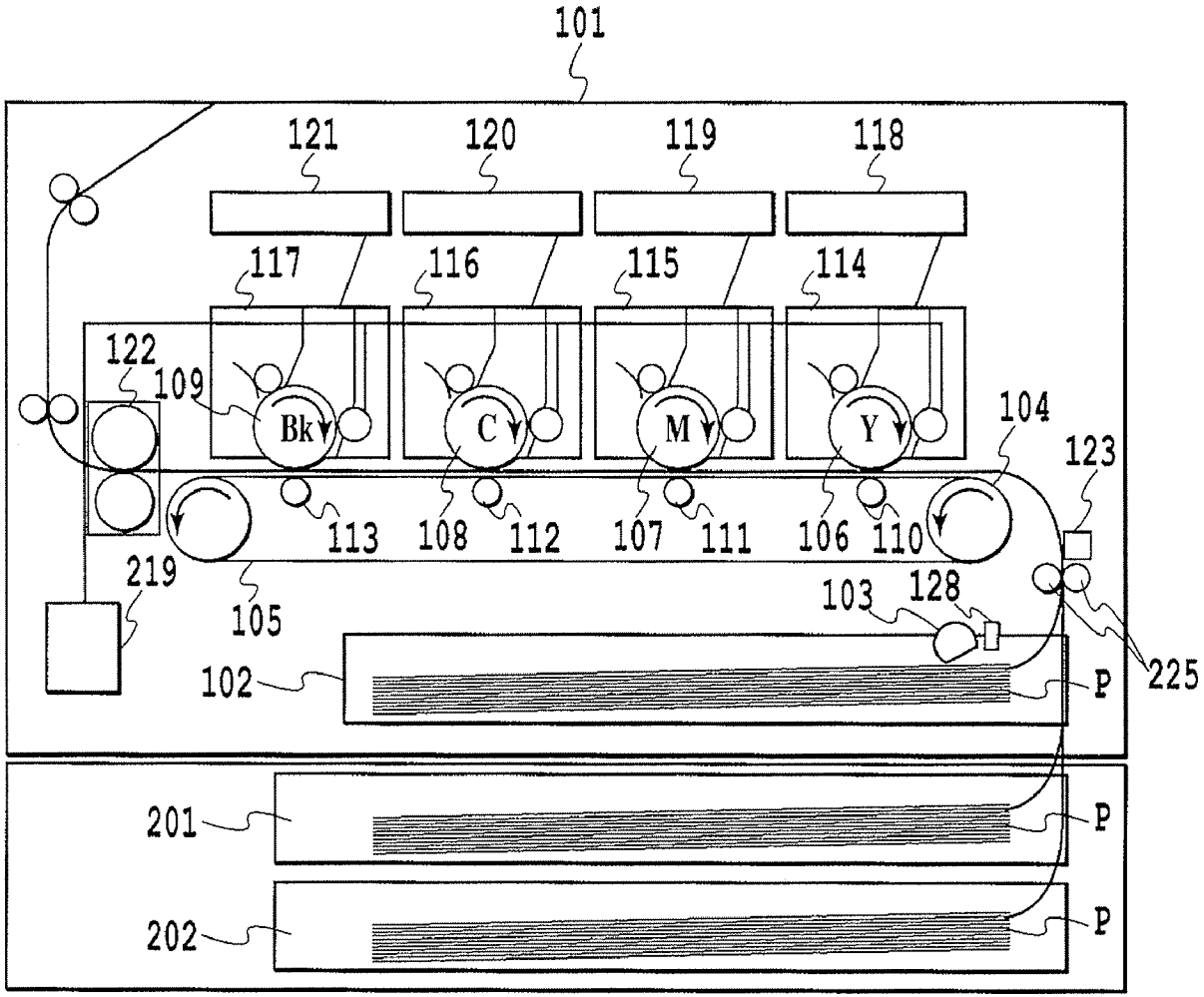
FIG. 13 is a view showing a second example of the image forming apparatus to which the present invention is applicable.
Figure 14:
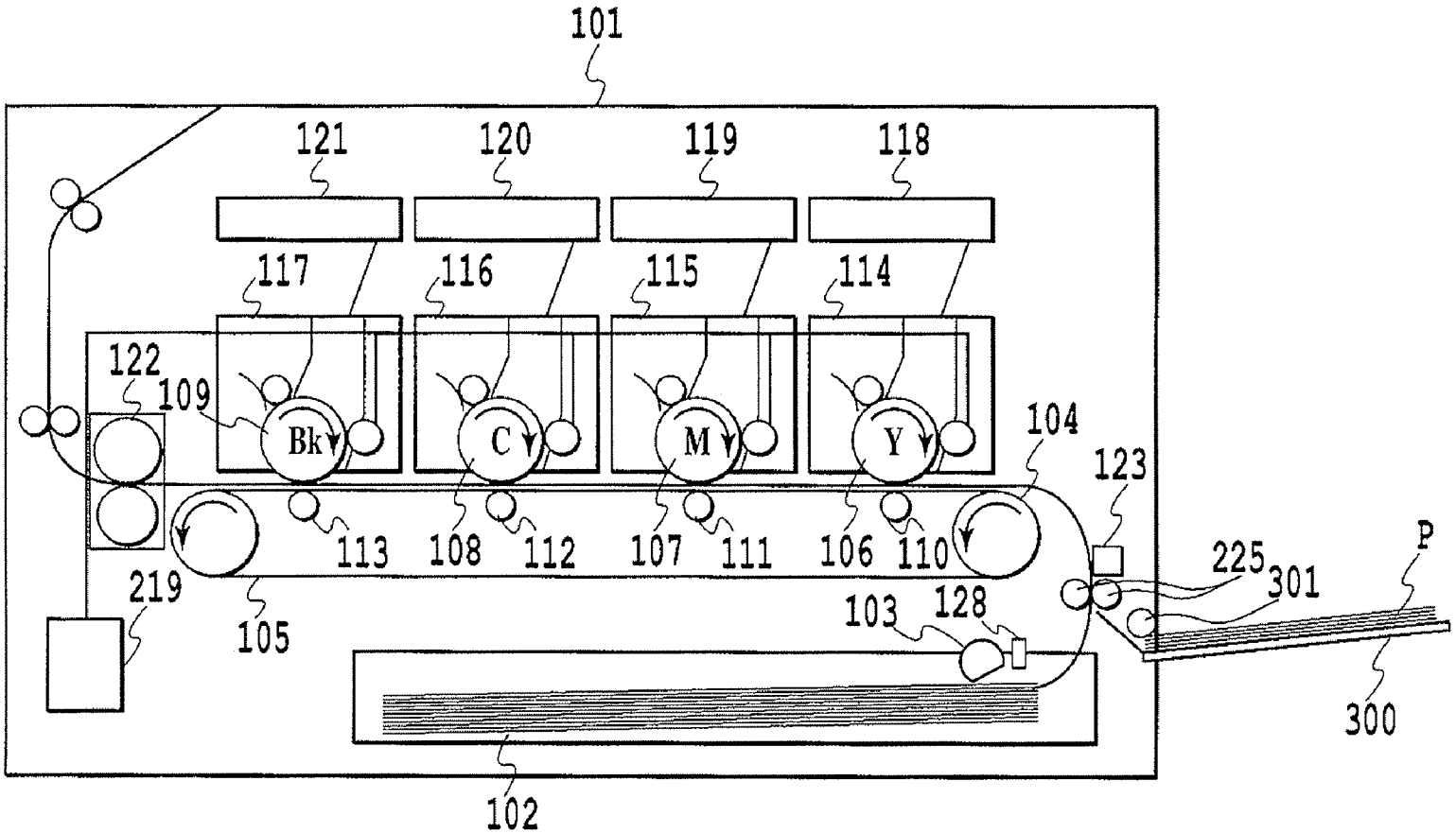
FIG. 14 is a view showing an image forming apparatus according to the second embodiment of the present invention.

The present invention is used in general image forming apparatuses as shown in FIGS. 12 to 14.

In FIG. 12, an image forming apparatus 101 includes a paper cassette 102; a paper feed roller 103; a transfer belt driving roller 104;a transfer belt 105; photoconductive drums 106 to 109 for yellow, magenta, cyan, and black colors, respectively; transfer rollers 110 to 113 for yellow, magenta, cyan, and black colors, respectively; cartridges 114 to 117 for yellow, magenta, cyan, and black colors, respectively; optical units 118 to 121 for yellow, magenta, cyan, and black colors, respectively; a fixation unit 122; a paper presence sensor 128; and a conveying roller 225 to convey paper. The paper presence sensor 128 senses the presence of paper in the paper cassette 102.

The image forming apparatus 101 generally uses an electrophotographic process. In this process, yellow, magenta, cyan, and black images are transferred on recording materials P so as to be superimposed on each other, and the transferred toner image is then heat-fixed by temperature controlled by the fixation unit 122, which includes a fixation roller. The process used in the image forming apparatus 101 is not limited to such a process. Moreover, the optical units 118 to 121 for yellow, magenta, cyan, and black colors are configured to perform exposure scanning on surfaces of the respective photoconductive drums 106 to 109 with laser beams to form a latent image. A series of these image forming operations are synchronized so that images can be transferred starting at a predetermined position on each conveyed recording material P.

Furthermore, the image forming apparatus 101 includes a paper feed motor to feed and convey the recording materials P. An image is formed as is desired on the surface of each of the fed recording materials P while the fed recording material P is conveyed from the transfer belt 105 to the fixation unit 122.

An image capture sensor 123 as a recording material identification unit is placed at a position just downstream of the conveying roller 225. Each of the fed recording materials P is conveyed by the conveying roller 225 and brought into a pause after a predetermined time has elapsed. In this state, a detection operation to identify the type of the recording material P is performed.

The image forming apparatus 101 shown in FIG. 12 includes an engine controller which controls a printing process of a printer; a video controller which controls the entire printer and analyzes and converts data from the host computer into image data; an option controller which controls various types of option units overall; and the like, which are not shown in the drawing. Herein, the engine controller controls the electrophotographic process carried out by an image recording section and the fixation unit and controls the conveying of recording paper. The video controller is connected to an external device (not shown) such as a personal computer through a general interface (USB, IEEE1394, and the like) . This video controller develops image information transmitted through the general interface into bit data and sends the bit data to the engine controller as signal VDO.

The image forming apparatus 101 shown in FIG. 13 includes a plurality of paper feed ports 102, 201 and 202 for holding recording material. Each of the paper feed ports 201 and 202, as the paper feed port 102, includes a paper feed roller 103 and a paper presence sensor 128, which are not shown in the drawing. As for FIG. 13, a description about same part as those in FIG. 12 is omitted.

Figure 1:
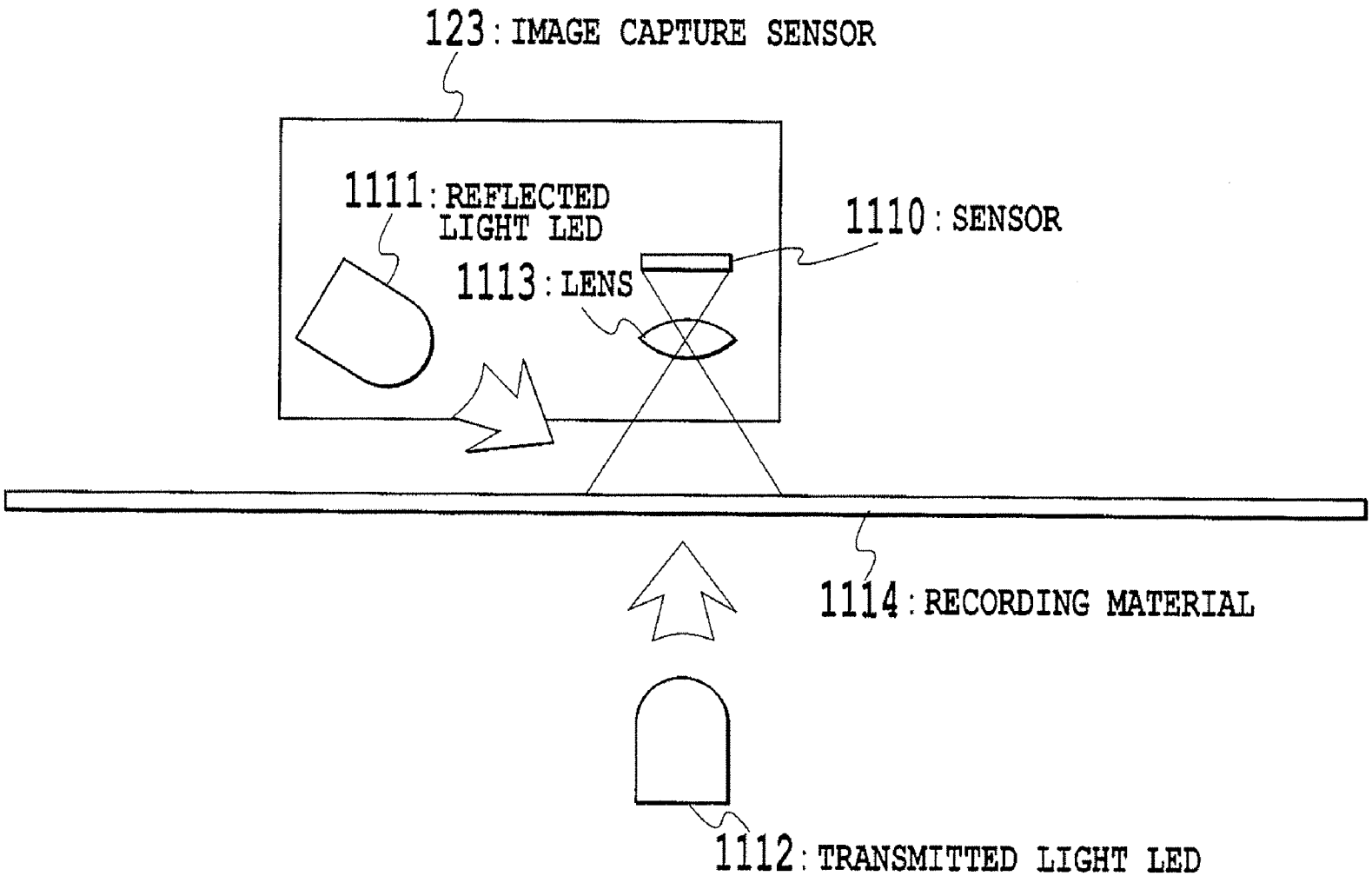
FIG. 1 is a view showing a schematic configuration of a recording material identification unit.

FIG. 1 is a schematic cross-sectional view showing a general configuration of a unit which detects information required for recording on recording materials, specifically, surface smoothness, a reflected light ratio (or a value indicating a reflectivity, more specifically, a value indicating an amount of reflected light) , and a transmittance (or a value indicating a transmittance, more specifically, a value indicating an amount of transmitted light) of the recording materials. Herein, when an amount of light emitted from a light source is previously determined, the reflectivity and the transmittance can be respectively calculated based on the value indicating the amount of reflected light and the value indicating the amount of transmitted light at least to an accuracy necessary for various settings of the image forming apparatus.

As shown in FIG. 1, the image capture sensor 123 includes an imaging lens 1113 providing an image in an capturing area on a recording material 1114; an area sensor 1110 placed in this imaging surface, a reflection LED 1111 as first light irradiation means which irradiates the imaging area obliquely from above; and a LED 1112 as second light irradiation means for detecting the amount of light transmitted through the recording material 1114. The LED 1112 is placed in downstream and on the back side of the capturing area of a recording material 1114 and emits light on the optical axis of the imaging lens onto the back surface of the imaging area in a direction in which the imaging lens 1113 is placed.

The light emitted from the reflection LED 1111 as a light source is irradiated onto a surface of the recording material 1114, that is, the surface on which recording is performed, so as to have a predetermined incident angle. The reflected light from the surface of the recording material 1114 is condensed through the imaging lens 1113, and is formed an image on the CMOS area sensor 1110. The image of the surface of the recording material 1114 is captured by controlling the CMOS area sensor 1110 and taking out an electric signal which is proportional to the amount of light received.

In this embodiment, the LED 1111 is placed so that the LED light obliquely irradiates the imaging area in the surface of the recording material 1114 at a predetermined angle as shown in FIG. 1. Accordingly, the reflected image from the surface of the recording material 1114 indicates irregularities of the paper surface in the imaging area. Specifically, bright part in the reflected image represents part of a concave or convex surface which faces the light source (part which reflects light directly entered from the LED) . Dark part in the reflected image represents part of a concave or convex surface facing the opposite direction to the light source (part onto which the light from the LED is not directly entered, and from which light transmitted through the recording material and then refracted exits; or part on which reflected light, from the vicinity thereof onto which light is directly entered from the LED, is again reflected).

Figure 2A:
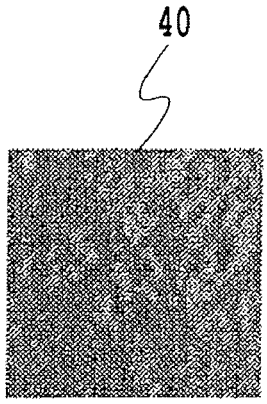
FIGS. 2A to 2F are views showing image examples of recording material surfaces and image examples obtained by performing digital processing for images reflected from recording material surfaces, which are read from an image capturing section in the recording material identification unit according to the present invention.
Figure 2B:
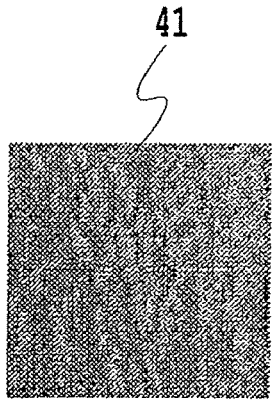
Figure 2C:
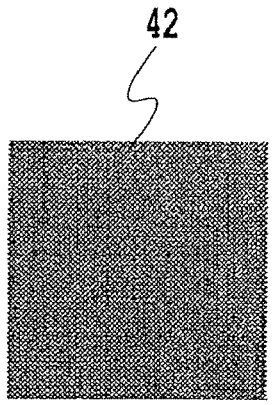
Figure 2D:
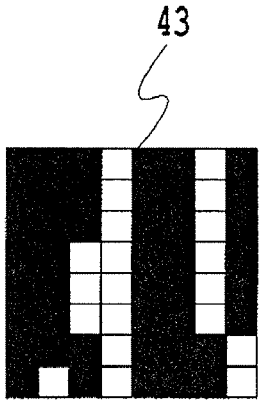
Figure 2E:
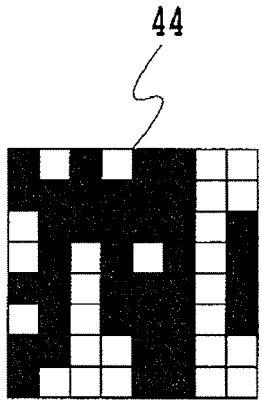
Figure 2F:
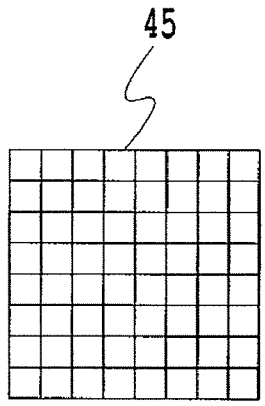

FIGS. 2A to 2C show examples of images of the surface of the recording material 1114 which are captured by the CMOS area sensor 1110 of the image capture sensor 123 when light is irradiated from the right in the drawings. The examples of FIG. 2A to 2C are denoted by reference numerals 40 to 42, respectively. FIGS. 2D to 2F show examples of views showing results of 8×8 pixels obtained by digital processing performed on these images outputted from the CMOS area sensor 1110. The examples of FIG. 2D to 2F are denoted by reference numerals 43 to 45. In these examples, light is irradiated from the right, but this is because variations in luminance in the right and left direction are detected in the images of FIGS. 2A to 2C as described later. The light may be irradiated from another direction depending upon the way the detection is performed.

The digital processing is performed by an A/D converter (not shown) as a conversion means converting the analog output from the CMOS area sensor 1110 to pixel data of 8 bits.

In FIGS. 2A to 2C, reference numeral 40 denotes an enlarged image of the surface of a recording material A of so-called rough paper. The rough paper has comparatively rough surface nature, and irregularities of the surface thereof due to fibers are easily identified. Reference numeral 41 denotes an enlarged image of the surface of a recording material B of so-called plain paper which is usually used in general offices. Reference numeral 42 denotes an enlarged image of the surface of a recording material C of glossy paper whose paper fibers are sufficiently compressed.

Light reflected on the surfaces of the recording materials indicated by the reference numerals 40 to 42 is captured by the CMOS area sensor 1110 and is subjected to the digital processing into the images (image data) indicated by the reference numerals 43 to 45 of FIGS. 2D to 2F. Note that the images indicated by the reference numerals 40 to 42 do not have direct correspondence with the images indicated by the reference numerals 43 to 45.

As described above, the image of the surface varies with the type of the recording material. This is a phenomenon occurring mainly because the state of fibers in the surface of paper varies.

At this time, information indicating the amount of light reflected from the recording material and inputted into the sensor is detected based on luminance levels of the pixels and a gain setting state of the sensor which has obtained these luminance levels. In this detection, it is acceptable to use a result of only one light receiving pixel.

As described above, the image of the recording material surface captured by the CMOS area sensor 1110 and subjected to the digital processing can be identified based on the surface state of paper fibers of the recording material and the amount of reflected light. It is also possible to calculate a generalized reflectivity of the recording material based on information indicating this amount of reflected light. However, the reflectivity does not need to be generalized, and the value indicating the amount of reflected light can be used as the value indicating the reflectivity as long as the amount of light entered into the captured area maintains a predetermined value.

As described above, the identification concerning the surface irregularities of paper fibers of a recording material and the reflectivity of the surface can be performed based on the surface image of the recording material which has been captured by the CMOS area sensor 1110 and subjected to the digital processing.

A description is given of the identification of the surface state of paper fibers of the recording material. Generally, such identification can be implemented by examination of a distribution of luminance values between the minimum and the maximum luminance values in image data captured. For example, in the case of the image 40 of the recording material A of FIG. 2A, a distribution of luminance values widely spread is obtained. The case of the image 42 of the recording material C of FIG. 2C shows a tendency for the range of the distribution of luminance values to be narrowed.

Herein, to easily detect the distribution of luminance values, the following method is employed. Specifically, among image data of the recording material surface, for example, examination is conducted for the whole image data in terms of a difference between luminance values of a pixel having a high-level luminance value indicating a face of concave or convex surface part which faces the light source (part on which light from the LED is directly entered) and a pixel having a low-level luminance value indicating a face of concave or convex surface part which faces the opposite direction to the light source (part onto which light from the LED is not directly entered). The identification of the surface state of paper fibers of the recording material is thus executed.

A recording material whose paper fibers in the surface are rough like the recording material A has large irregularities due to the paper fibers. Accordingly, when the recording material surface is irradiated obliquely from above, the area of the part onto which light from the light source is not directly entered, that is, shadow part, is large. The luminance thereof is less than that of the part onto which light from the light source is directly entered. The difference between the bright and the dark places is therefore made large, and accordingly, difference in luminance becomes large. On the other hand, the area of the shadow part is smaller than the area in the case of large irregularities when the irregularities of paper fibers are small as in the case of the recording material C. Accordingly, though depending on the capturing method, the low luminance of the shadow part less contributes the luminance value of one pixel. Alternatively, some part receives reflected light from the vicinity thereof onto which light from the light source is directly entered, and accordingly, the difference in luminance between pixels of the bright captured place and that of dark captured place is small. It is thus possible to obtain information necessary for recording on the recording material, or specifically, the type (plain, rough, or glossy paper) of the recording material whose image is captured by capturing images of the reflected light from the recording material surface.

Next, a description is given of a method of calculating data which indicates the amount of light transmitted through the recording material 1114. The light from the transmission LED 1112 as the second light irradiation means, which is the light source, irradiates an area to be captured by the image capture sensor 123 on the recording material 1114 from the opposite side to the image capture sensor 123.

Figure 3:
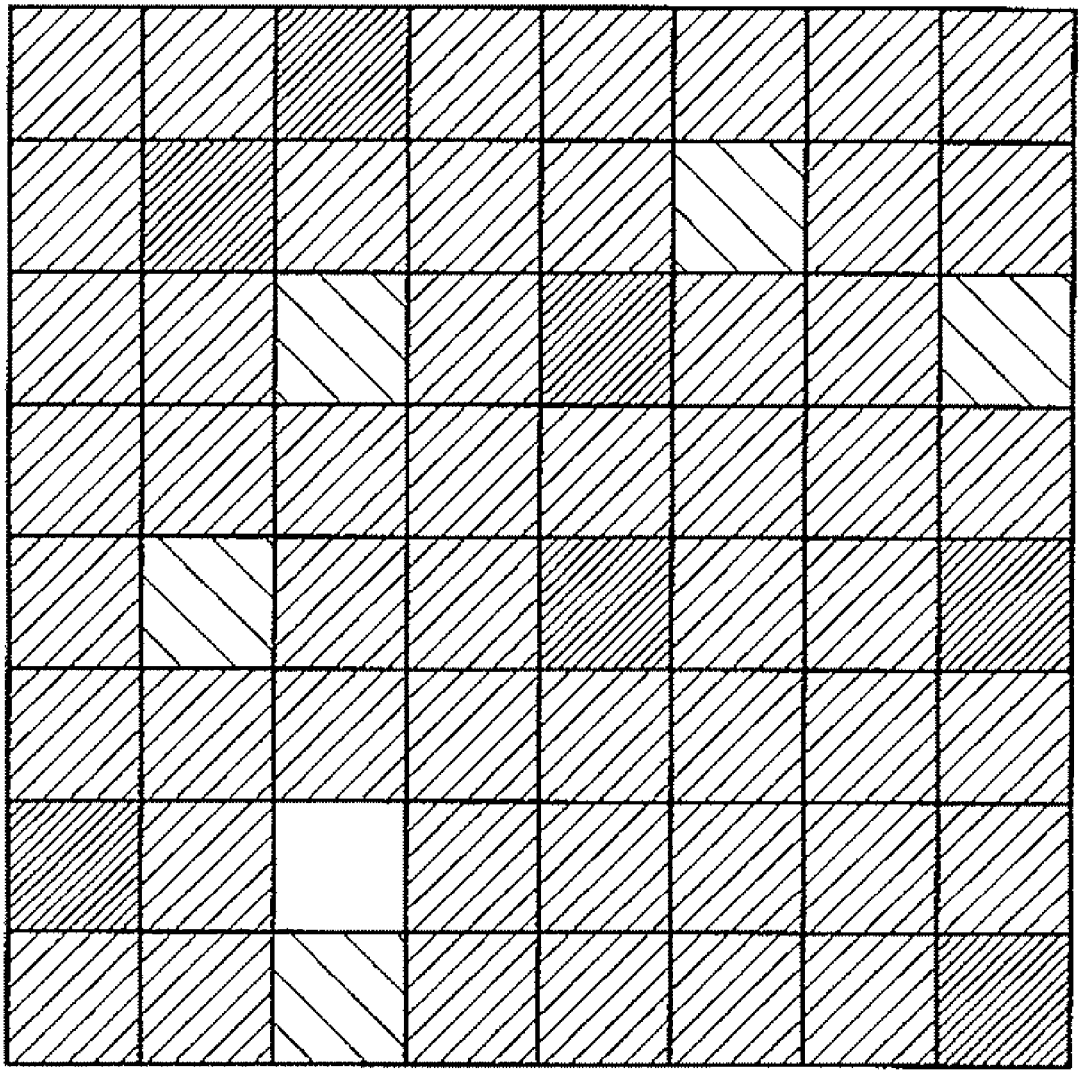
FIG. 3 is a view showing an image example obtained by performing digital processing for a transmitted light image of a recording material, which is read from the image capture section of the recording material identification unit.

FIG. 3 is a view showing an image example of 8×8 pixels obtained by capturing the surface of the recording material 1114 with transmitted light LED 1112 and the CMOS area sensor 1110 of the capturing sensor 123 and performing digital processing for data outputted from the CMOS area sensor 1110.

The light transmitted through the recording material 1114 is condensed through the lens 1113 to irradiate the CMOS area sensor 1110. At this time, the amount of transmitted light is obtained based on the luminance value of each pixel in an entire area or a predetermined area of the sensor 1110 and on the gain adjusting value set in the sensor 1110. The gain adjusting value is a value to adjust the value outputted from the sensor 1110, when the amount of transmitted light is too much or too little, so as to make the value of the amounts of light proper. The luminance values of pixels used herein may be luminance values of only arbitrary pixels out of the plurality of light receiving pixels.

Figure 4:
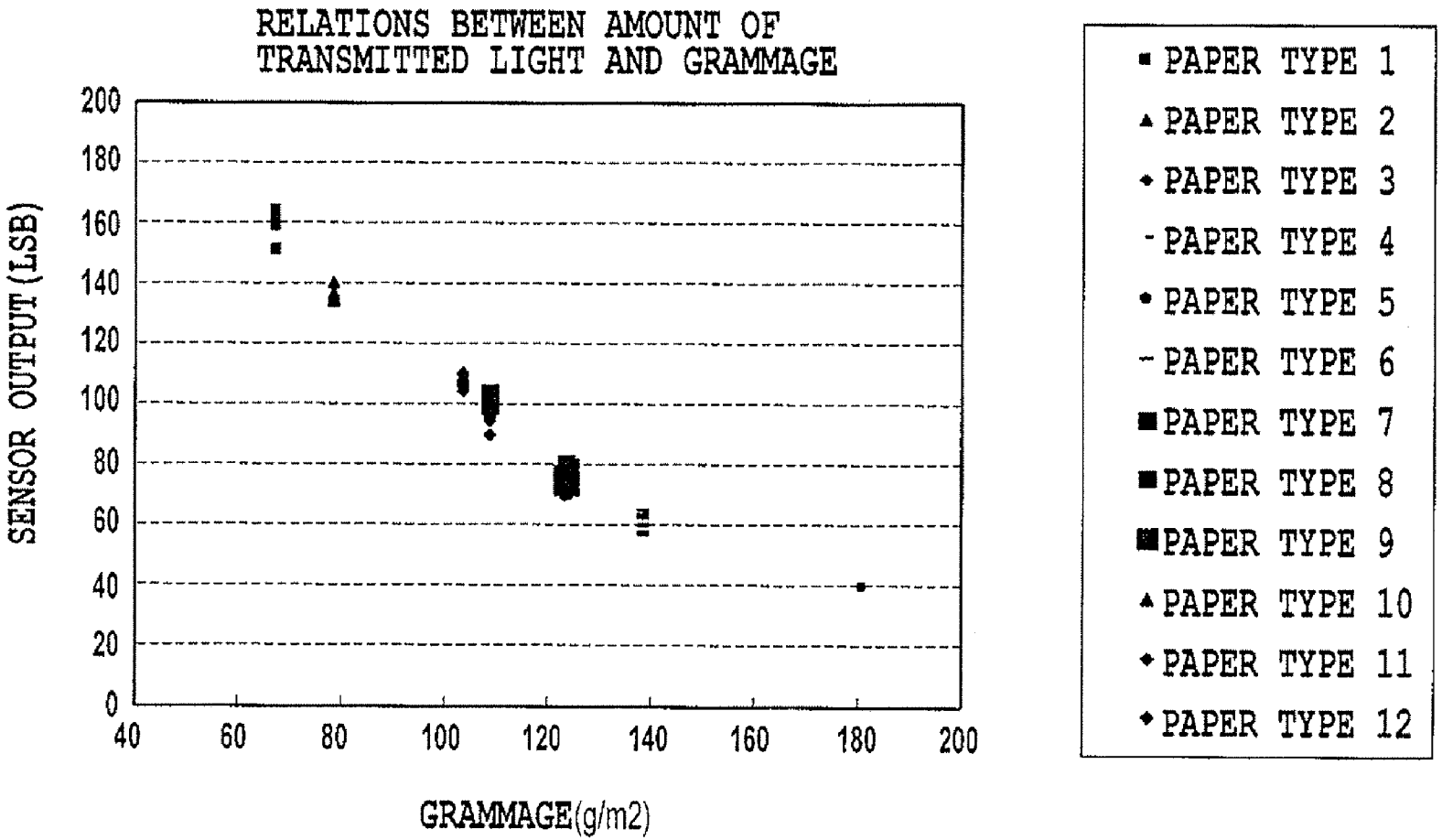
FIG. 4 is a graph showing relations between grammage and amount of transmitted light.

FIG. 4 is a graph showing a relation between grammage and transmitted light. The grammage is weight in grams per square meter. As for the recording material with a larger grammage, for example thick paper, the amount of light transmitted therethrough is small. On the other hand, as for the recording material with a smaller grammage, for example thin paper, the amount of light transmitted therethrough is large. As shown in FIG. 4, paper with four types of grammage can be identified (thin paper (grammage: less than 65 g/m$^2$), plain paper (grammage: 65 to 105 g/m$^2$), thick paper 1 (grammage: 106 to 135 g/m$^2$), and thick paper 2 (grammage: more than 135 g/m$^2$)).

Figure 5:
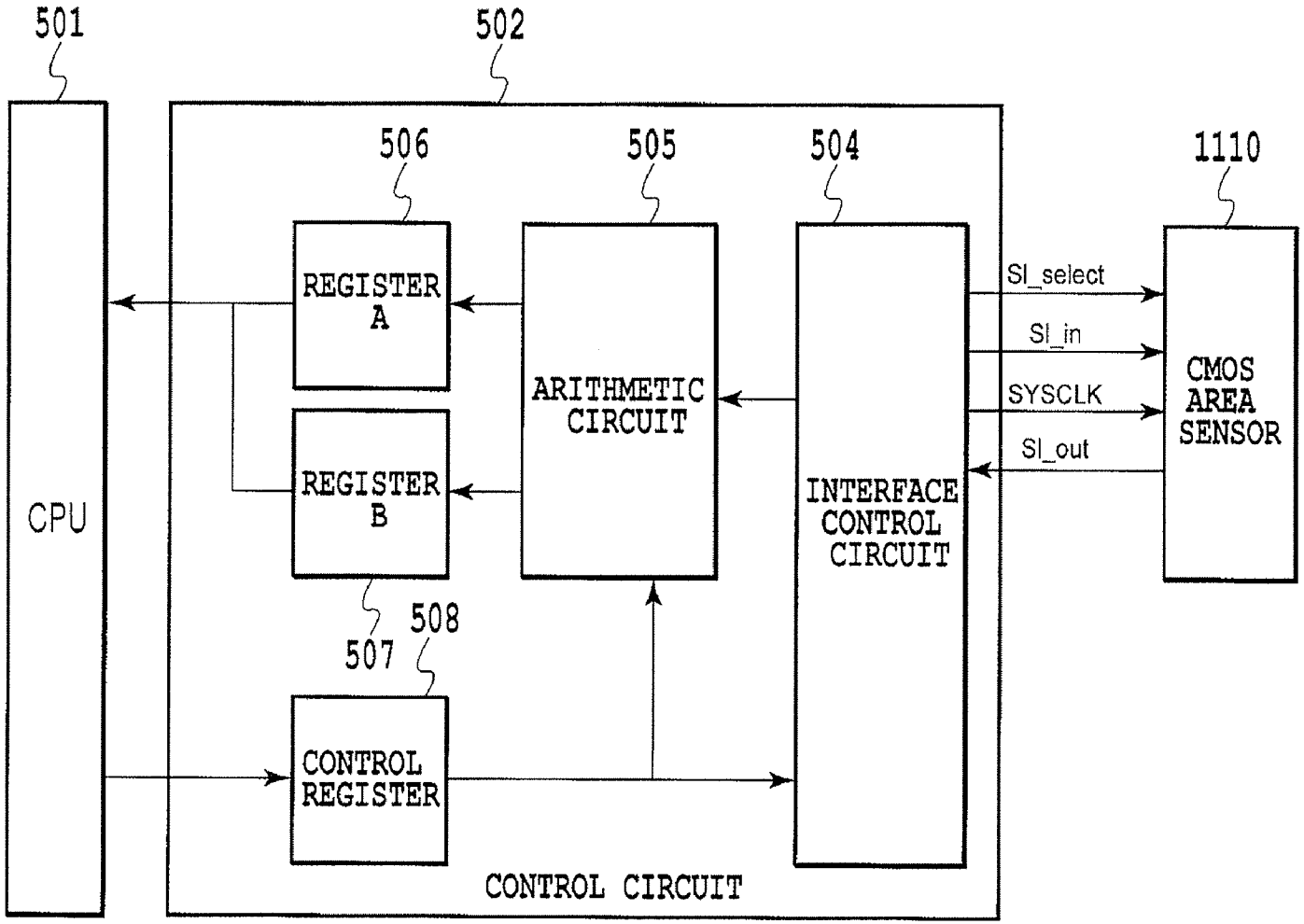
FIG. 5 is a diagram showing blocks of a control circuit interfaced with a CMOS area sensor as a sensor within the recording material identification unit.
Figure 6:
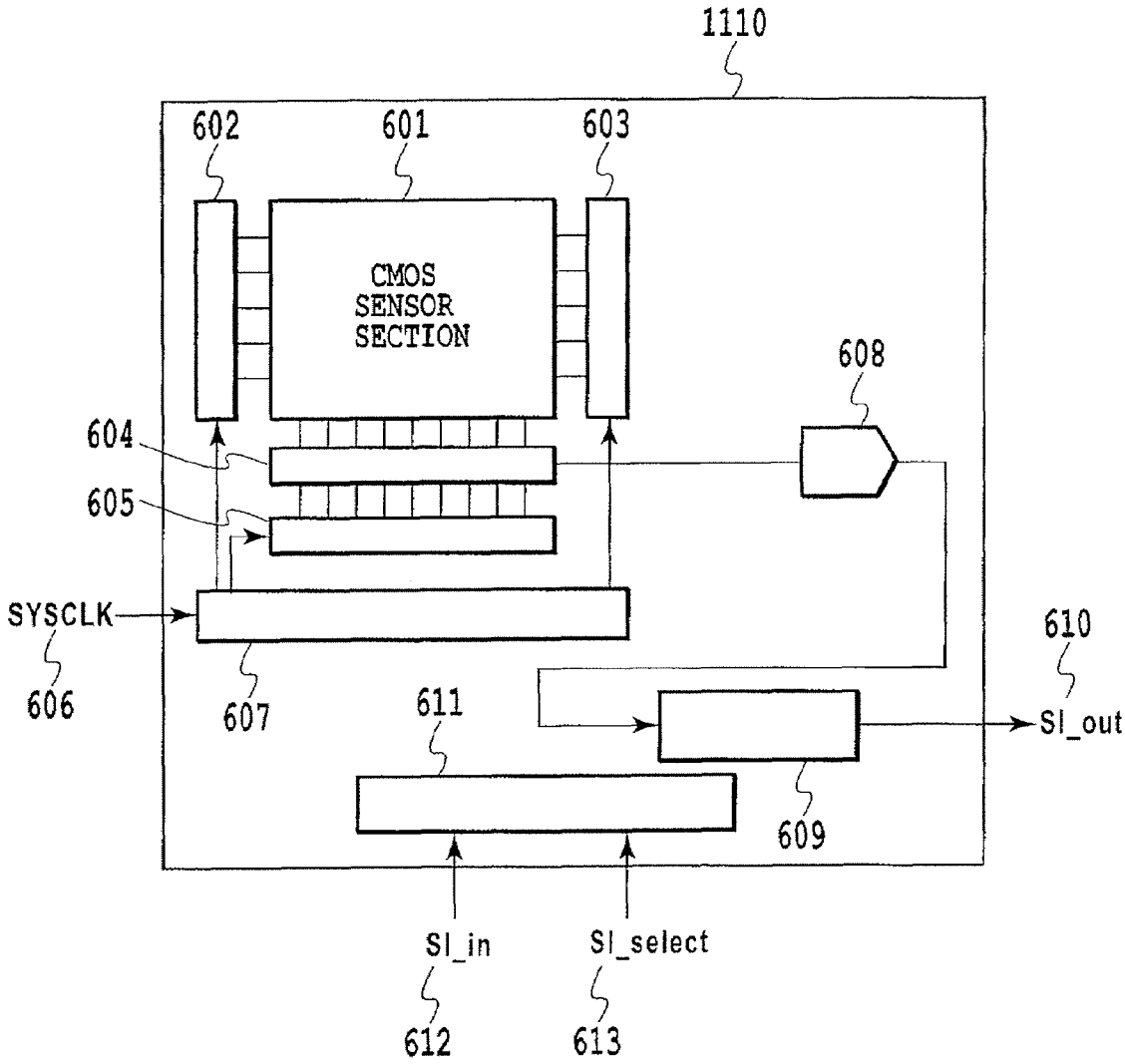
FIG. 6 is a diagram showing blocks of the C-MOS sensor circuit as the sensor.

Next, using FIGS. 5 and 6, a description is given of a control circuit block diagram of the CMOS area sensor 1110 used in this embodiment.

FIG. 5 shows a control circuit block diagram of the CMOS area sensor 1110. In the drawing, reference numeral 501 denotes a CPU, which is interfaced with the reflected light LED 1111 and transmitted light LED 1112 of FIG. 1 and a control circuit 502 of FIG. 5 controlling the CMOS area sensor 1110. As for the control circuit 502, FIG. 5 shows only main internal components thereof. Reference numeral 504 denotes an interface control circuit for the CMOS area sensor 1110; 505, an arithmetic circuit; 506, a register A in which the irregularity indication value A of the recording material surface is set; 507, a register B in which the irregularity indication value B of the recording material surface is set; and 508, a control register. The control circuit 502 may include another register in which data indicating the amount of reflected light from a recording material as the capturing object is set through the operational circuit 505 based on the data obtained from the sensor 1110, or may include still another register in which data indicating the amount of light transmitted through the recording material, which is described later, as the capturing object is set based on the data obtained from the sensor 1110. Herein, these registers are not shown in the drawing.

Next, in connection with FIG. 5, a description is given of operations of each of the components. The CPU 501 sets predetermined data at the control register 508 in order to provide operating instructions to the CMOS area sensor 1110. Upon being instructed through the interface circuit 504 based on the set data to start operation, the CMOS area sensor 1110 starts capturing the image of the recording material surface. In other words, electrical charges start to be accumulated in the CMOS area sensor 1110. At this time, one of the reflected light and transmitted light LEDs is controlled by the CPU 501 to be turned on for irradiation through a not-shown control line.

When the interface circuit 504 selects the CMOS area sensor 1110 with an S1_select signal and generates a SYSCLK signal at a predetermined timing, captured digital image data is transmitted from the CMOS area sensor 1110 through an S1_out signal.

When the image data received through the interface circuit 504 is data of the image captured by only the reflected light LED 1111 being turned on, the control circuit 502, firstly, applies an operation to the data based on the first calculation method later described. The result thereof is set in the register A 506 as the irregularity indication value A of the recording material surface. As described above, the amount of irregularities is calculated in the arithmetic circuit 505 as the value indicating the amount of reflected light from a recording material as the capturing target, and is set in a not-shown register.

Next, the irregularity indication value B of the recording material surface is calculated by the control circuit 502 based on the second calculation method described later, and the result thereof is set in a register B 507 as an irregularity edge amount indication value B of the recording material surface. The CPU 501 can judge the surface smoothness of the recording material from the values of the above two registers and identify the type of the recording material. The CPU 501 can judge the surface smoothness and identify the type of the recording material based on, for example, data indicating the amount of reflected light, which is obtained from the sensor and registered in a not-shown register.

The aforementioned control circuit 502 needs to perform signal processing for the CMOS area sensor 1110, sampling processing for the subsequent images and gain and filter arithmetic processing in real time. For this purpose, it is desirable to employ a digital signal processor for the control circuit 502.

Next, a description is given of a circuit block diagram of the CMOS area sensor using FIG. 6. FIG. 6 is a circuit block diagram of the CMOS area sensor 1110. In the drawing, reference numeral 601 denotes a CMOS sensor section, in which sensors for 8×8 pixels are arranged on the area. Reference numerals 602 and 603 denote vertical shift registers; 604, an output buffer; 605, a horizontal shift register; 606, a system clock; and 607, a timing generator.

Next, the operation thereof is described. Upon the S1_select signal 613 being turned active, the CMOS sensor section 601 begins to accumulate electrical charges according to the received light. Next, when the system clock 606 is given, the timing generator 607 causes the vertical shift registers 602 and 603 to sequentially select a row of pixels to be read out, and the data is sequentially set in the output buffer 604.

The data set in the output buffer 604 is transferred to the A/D converter 608 by the horizontal shift register 605. The pixel data digitally converted by the A/D converter 608 is controlled by the output interface circuit 609 at a predetermined timing and outputted to the S1_out signal 610 while the S1_select signal 613 is active.

On the other hand, an A/D conversion gain can be variably controlled by the control circuit 611 through the S1_in signal 612. For example, when the captured image does not have enough contrast, the CPU changes the gain so that an image with optimal contrast can be always captured. Herein, based on the set gain and the level of the captured image, the value indicating the amount of reflected light from the captured recording material surface (to be exact, the value corresponding to the amount of light received by the sensor and photoelectrically converted) can be derived as a function of the gain and the level (average level).

Figure 7:
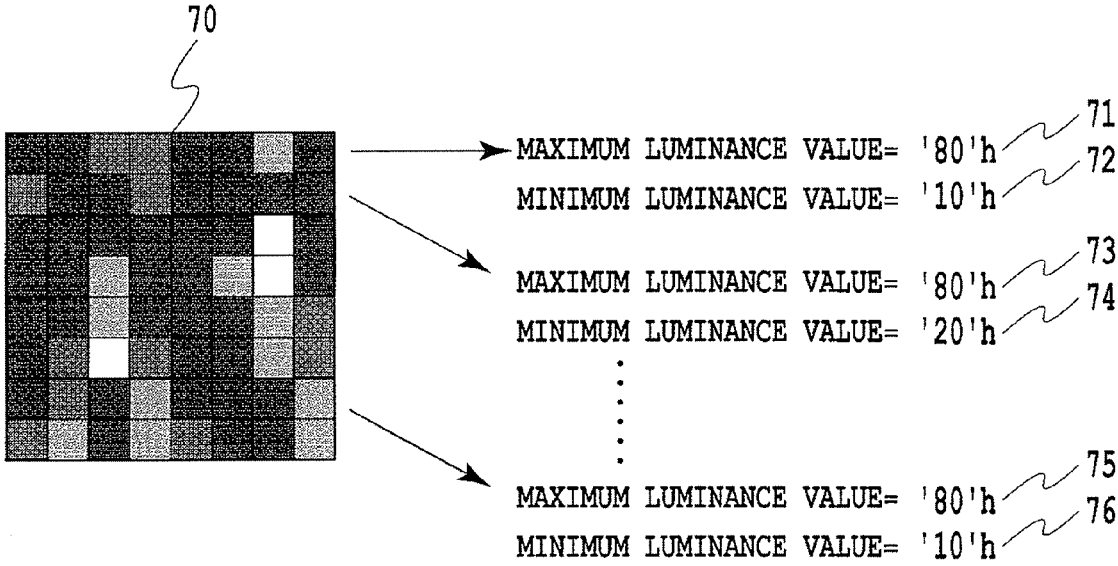
FIG. 7 is a view for explaining a first calculation method to calculate an irregularity indication value A of a recording material surface.

Next, using FIG. 7, a description is given of identification of the surface state of paper fibers of a recording material, specifically, the first calculation method which calculates the irregularity indication value A of the recording material surface, in other words, which calculates the aforementioned value to be set in the register A (by first operation means). The image 70 of FIG. 7 is a view showing an example of an image obtained by performing the digital processing for an image of the recording material surface.

The analog output from the sensor section of the CMOS area sensor is A/D converted into pixel data of 8 bits. This 8 bit data is proportional to the amount of light of the part corresponding to each of the pixels of the image of the light reflected from the recording material surface.

In the image 70 of FIG. 7, the maximum luminance value 71 is of the brightest pixel in the first line of the 8×8 pixels. In the example of the drawing, the maximum luminance value 71 has a level of '80'h. The minimum luminance value 72 is of the darkest pixel in the first line of the 8×8 pixels. In the example of the drawing, the minimum luminance value 72 has a level of '10'h. At this time, the difference between the luminance values of the two pixels is '80'h−'10'h='70'h. Specifically, a value indicating contrast in the first line, that is, the difference between the maximum and minimum luminance values, is '70'h. Herein, the value indicating the contrast is defined as the difference between the maximum and minimum values for simplification of the calculation, but may be a difference between the second maximum value and the second minimum value. Alternatively, the value indicating the contrast may be a difference between an average of luminance values of a plurality of pixels which are close to the maximum value and an average of luminance values of a plurality of pixels which are close to the minimum value or may be a variance value of those of a target pixel line.

In a similar manner, the maximum luminance value 73 is of the brightest pixel in the second pixel line and has a level of '80'h. The minimum luminance value 74 is of the darkest pixel in the second pixel line and has a level of '20'h. The difference between the luminance values is '80'h−'20'h ='60'h.

The maximum luminance value 75 is of the brightest pixel in the eighth pixel line and has a level of '80'h. The minimum luminance value 76 is of the darkest pixel in the eighth pixel line and has a level of '10'h. The difference between these luminance values is '80'h−'10'h='70'h.

An cumulative value obtained in such a manner that the difference between the maximum and the minimum luminance values of pixels in each line is summed for all the lines (all pixel lines) is set in the register 506 of FIG. 5 as the value indicating the contrast of the target pixel lines. The cumulative value thus obtained is herein defined as the irregularity indication value A of the recording material surface. Note that in FIG. 7, the differences between the maximum and the minimum luminance values of the individual horizontal lines are calculated and added up for easy address control in a memory storing the image data. In another method, the irregularity indication value A of the recording material surface may be a value calculated in a similar manner for the vertical lines instead of the horizontal lines or for a plurality of blocks instead of the horizontal lines.

Figure 8A:
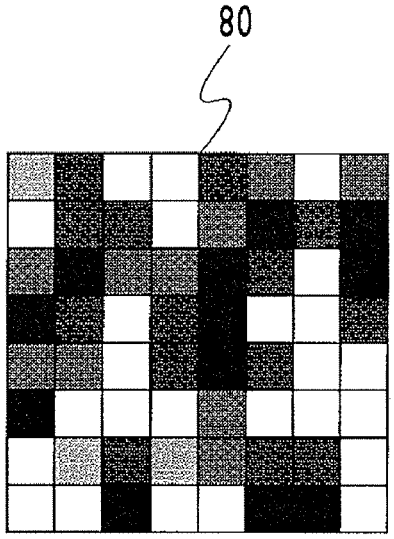
FIGS. 8A and 8B are views for explaining a second calculation method to calculate an irregularity indication value B of a recording material surface.
Figure 8B:
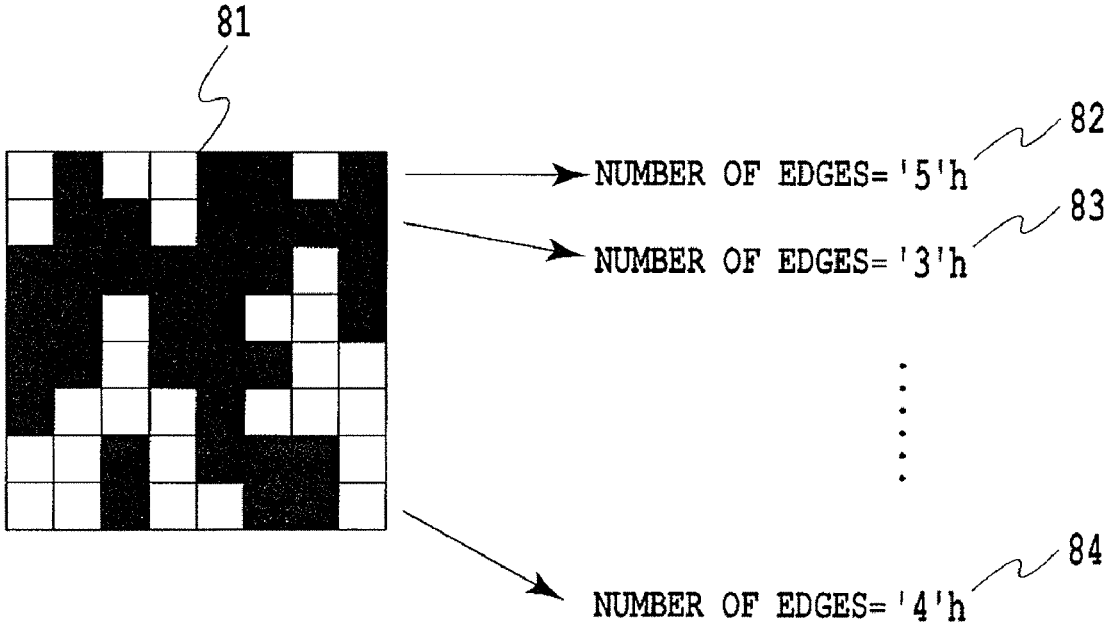

Next, using FIGS. 8A and 8B, a description is given of identification of the surface state of paper fibers of a recording material, or specifically the second calculation method which calculates the irregularity indication value B of the recording material surface, in other words, which calculates the aforementioned value to be set in the register B (by second operation means).

An image 80 shown in FIG. 8A is an image obtained by performing the digital processing for an image of the reflected light from the surface of a recording material. An image 81 shown in FIG. 8B is a result of calculating an average of the luminance values of the image 80 captured at a previous sampling timing and binarizing the 8×8 pixels captured at the next sampling timing with the above average used as a threshold value. A place where data (1/0) is inverted when each line of this binarized two-dimensional image is scanned is defined as an edge. At this time, the number of the edges indicated by reference numeral 82 is the number of edges in the first line, and the number is "05" h in this example. Reference numeral 83 denotes the number of edges in the second line, and the number is "03"h in this example. A number 84 of edges is similarly the number of edges in the eighth line, and the number is "03"h in this example.

A value obtained by counting the number of edges of each line and adding up these numbers of edges of all the lines, that is, the total number of edges, is defined as the irregularity edge amount indication value B of the recording material surface.

As described above, according to the recording material identification unit shown in FIG. 1, as the information indicating the irregularity condition of the surface of the recording material, it is possible to obtain two types of information, one of which is the information indicating the amount of reflected light or reflectivity of the surface of the recording material, and the other of which is the information indicating the thickness or transparency of the recording material based on the amount of light transmitted through the recording material or the transmittance thereof. Each of these two types of information is used either on its own or in combination when the operation conditions, drive conditions, and the like are set in each unit of the image recording apparatus. Simultaneously, it is possible to identify the paper type of the recording material from the information. Types of the recording material which can be identified are at least of six types: plain paper, rough paper, glossy paper, thin paper, thick paper 1, and thick paper 2.

Figure 9:
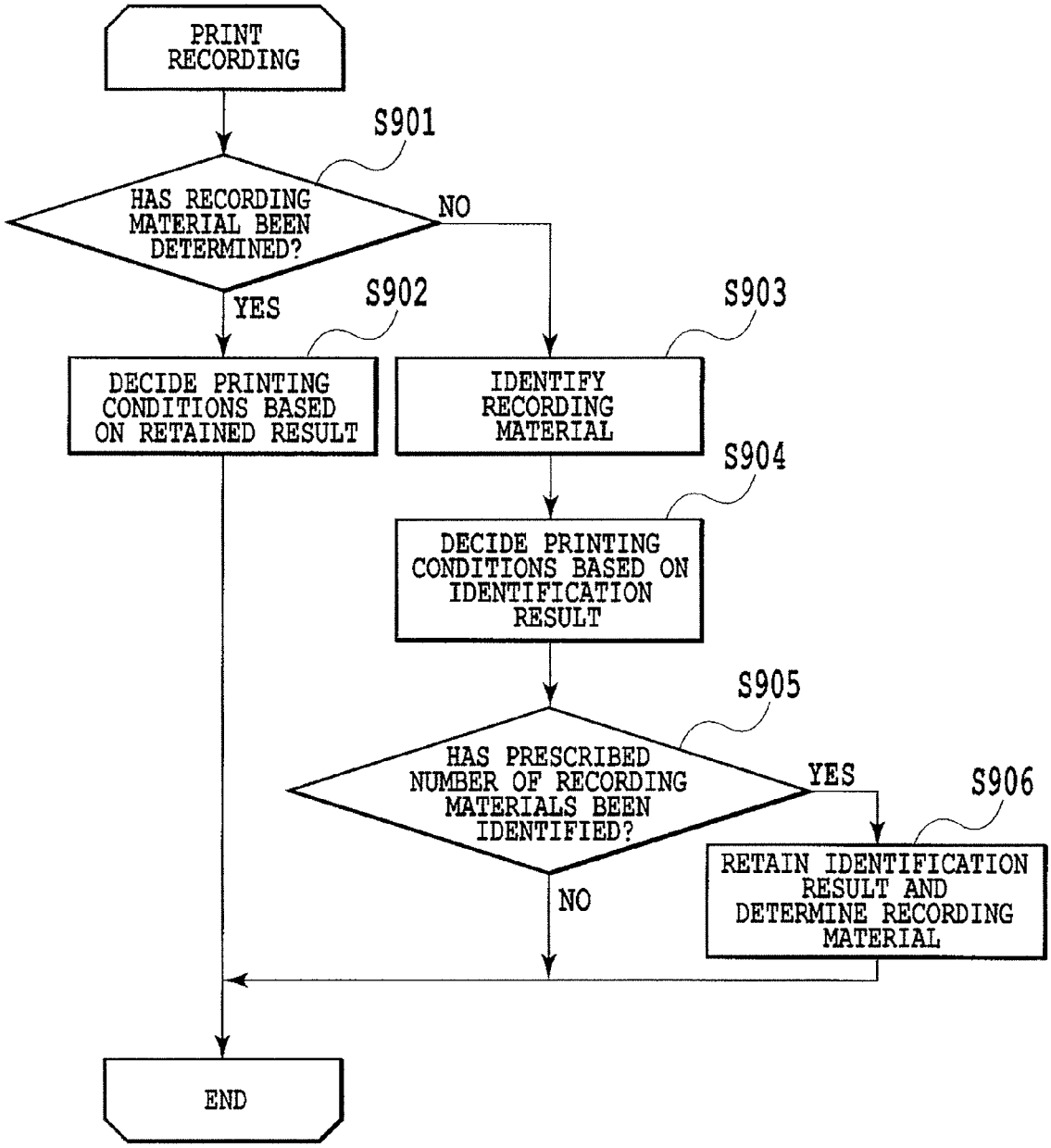
FIG. 9 is a flowchart for explaining control of printing conditions in a first embodiment of the present invention.

Next, a description is given of an embodiment when the aforementioned recording material identification unit is applied to the electrophotographic image forming apparatuses (FIGS. 12 and 13). FIG. 9 is a control flow by the CPU 501 related to settings of printing conditions of the image forming apparatus 101. The CPU 501 can be an engine controller, a video controller, or an option controller, which are described in relation to FIG. 12 or can be an independent CPU managed by these controllers.

A process shown in FIG. 9 is started when a printing operation in the image forming apparatus is started. For example, the process is started after the aforementioned video controller receives and analyses a print job. When the process is started, the CPU 501 first checks whether a determined value is stored as the result of the recording material identification for a paper feed port specified (by the received print job) (S901). When the determined value of the results of the recording material identification is stored, the printing conditions are decided using the stored determined value of the results of the recording material identification without performing another recording material identification for the recording material (S902) , and the process is terminated. When no determined value of the result of the recording material identification is retained, another recording material identification is performed for the recording material and the obtained result is stored (S903). The printing conditions are then decided based on the obtained identification result (S904) Subsequently, it is checked whether the results of the recording material identification for the prescribed number of sheets are stored (S905). When the results for that number are stored, the identification is determined (S906), and the determined value is stored. This process is thus terminated. When the results are not stored, the process is terminated. The fact that the record material type is determined in S906 is confirmed in S901, and the determined value is used in S902. In S906, the identification result stored in each S903 is examined.

Herein, the prescribed number of sheets and the determination of recording materials are described. In a paper feed port (cassette) , usually, a lot of sheets are set at a time. Although a few sheets are set at a time in some cases, in this case, it is rarely done by stacking the few sheets onto those of another type. For example, to use only ten sheets of a paper type different from plain paper used so far, only the ten sheets of the different paper type are set. However, as only ten sheets are set, when the number of sheets to be printed is increased to eleven as a result of various types of editing before printing, the printing operation is stopped with an error message being displayed for the last page that there is no sheet. In this case, if an additional sheet is set, the printing would be done on the sheet of the predetermined type. However, if sheets of a different type are placed on the sheets of plain paper, the last page would be printed on the plain paper, and the user sometimes does not notice the fact. Even when the user notices the fact, the printing process needs to be performed again only for the last page, which takes a lot of trouble. In consideration of such a situation, the recording material identification is, first, performed for the first several sheets of each of the plurality of paper feed ports (cassette). The number of the aforementioned several sheets is previously determined as a prescribed number. In a normal case, results obtained from these several sheets (the prescribed number of sheets) in a paper feed port (cassette) on which sheets the recording material identification is performed must be the same or similar. Based on these same or similar results for the several sheets (the prescribed number of sheets), the identification of recording materials set in the paper feed port (cassette) of interest is determined. After this determination is conducted, printing is carried out using the determined result as the identification of recording materials fed thereafter. Each of the fed recording materials is subjected to the identification until the recording material identification is determined.

Herein, a description is given of an example of conditions for the aforementioned judgment in S904, that is, the determination. For example, in a first method, a distribution of a series of the identification results for a first predetermined number of sheets is examined. Specifically, it can be judged that the determination is made when the difference between the maximum and the minimum values of the irregularity indication value of the recording material surface is within a first threshold value 1*a*, the difference between the maximum and the minimum values of the reflectivity is within a first threshold value 1*b*, and the difference between the maximum and the minimum values of the amount of transmitted light is within a first threshold value 1*c*. In a second method the recording material identification is firstly performed for a first predetermined number of sheets with the first method. When the recording material type cannot be determined herein and the above differences exceed respective second threshold values which are larger than the respective first threshold values, the aforementioned examination is repeated until the identification results of the recording materials meet the aforementioned conditions for a second predetermined number of sheets. At the time when the identification results meet the conditions, the determination is conducted based on the results. Herein, when the differences do not exceed the respective second thresholds, the above examination is repeated until the differences between the maximum and the minimum values of the identification results of the recording material surfaces of the first predetermined number of sheets fall within the respective first threshold values including the identification results obtained in the first method. When the above differences are within the respective threshold values, the determination is conducted. The aforementioned determination conditions are just an example, and various modifications of these methods can be conceived. For example, there are methods which use as the irregularity indication value both of or one of the aforementioned indication values A and B. Moreover, it can be decided whether to determine the identification by considering the identification results of the irregularity indication values A and B, reflectivity, and transmittance. The aforementioned plurality of same or similar results are the recording material type which is decided using both of the irregularity indication values A and B, reflectivity, and transmittance of the recording material surface, which are calculated by the aforementioned method. In other words, the type is a parameter for setting the printing conditions. The determination of the recording material is therefore decided based on the average of the irregularity indication values of the surface of the recording material, an average of the irregularity indication values except the maximum and the minimum values thereof, or the like. The printing conditions are decided in S904 using the identification results of the recording material surface obtained in the previous step.

Moreover, in FIG. 9 described above, the printing conditions are set based on the identification result of the first sheet until the recording material type is determined, that is, while the detection is being performed for the prescribed number of sheets.

FIGS. 15A and 15B show setting of the printing conditions for each page of each print job. These tables show items including a job number, the number of sheets printed, detection execution indicating whether to detect the recording material type, and paper type status for setting of the printing conditions. Herein, examples are shown in the case where the prescribed number of sheets is set to five.

FIG. 15A shows an example including two print jobs; the first and the second jobs are for six and two pages, respectively. Herein, the printing conditions of the first job are set based on a detection result a of the first page (corresponding to the number of printed pages from the top of 1 in the drawing). Subsequently, the printing conditions of the second job are set based on the detection result β which is determined by the detection at the first to fifth pages. The detection result β is stored as the determined result of the recording material type.

Herein, the reason why the printing conditions of the first job are set based on the detection result α even after the recording material type is determined is that the quality, colors, and the like of a formed image can be changed when the printing conditions are changed in a single print job. Moreover, it sometimes takes time to change the printing conditions, and accordingly, image forming speed can be reduced. The printing conditions are therefore not changed during the first job.

FIG. 15B shows an example including three print jobs; the first, the second, and the third jobs are for three, four, and one page, respectively. In this case, the printing conditions of the first and second jobs are set based on the detection result α of the first page of the first job. The recording material type is determined at the second sheet of the second job (the number of printed sheets from the top of five in the table). The detection result β determined begins to be reflected on the third job. The reason for setting the printing conditions of the second job based on the detection result α is the same as that described in the example of FIG. 15A.

Herein, controls of the various printing conditions executed by the CPU 501 are as follows. For example, the CPU 501 conducts a control to change colors by changing the y curve to a setting different from that of the plain paper when the recording material type is glossy paper. This is because when printing is performed using the glossy paper, it is desired to increase the contrast on the recording material. Moreover, the CPU 501 makes a control to change fixation temperature of the fixation unit according to the type of the fed recording material. In the case of thick paper which is thicker than plain paper, due to its larger heat capacity than that of the plain paper, the toner image is poorly fixed onto the thick paper at the same fixation temperature as in the case of the plain paper. Accordingly, when identifying the recording material as thick paper, the CPU 501 makes a control so as to secure toner fixation onto the thick paper by setting the fixation temperature higher than that of the plain paper. Furthermore, the CPU 501 identifies the type of the fed recording material and makes a control to change the conveying speed of the recording material according to the result of the identification. Specifically, when the type of the recording material is thick paper which is thicker than the plain paper, due to its larger heat capacity than that of the plain paper, the toner image is poorly fixed onto the thick paper at the same conveying speed as in the case of the plain paper. When identifying the recording material type to be thick paper, the CPU 501 therefore sets the conveying speed of the recording material lower than that at the time when the plain paper is conveyed so as to increase the amount of heat supplied to the thick paper per unit time. Moreover, there is a fixation method in which different fixation temperature conditions are set for recording materials with different grammages as follows. For example, for a comparatively thick recording material, which has a large heat capacity, the fixation temperature is controlled to be high. On the other hand, for a comparatively thin recording material, which has a small heat capacity, the fixation temperature is set lower. The CPU 501 can make a control of the printing conditions by changing the conveying speed of the recording material according to the grammage of the recording material. In the case of OHT, glossy paper, or the like, it is possible to identify these paper types and enhance the fixation of the toner adhering to the recording material surface to increase the gloss and improve the image quality.

As described above, according to the first embodiment of the present invention, in the image forming apparatus which includes a plurality of paper feed ports including trays for accommodating recording materials, the identified and determined recording material type is stored for each paper feed port. The first embodiment is characterized by using the previously stored identification result in a print job performed after the recording material is determined and omitting the identification processing of the recording material type. Certainly, the first embodiment has a similar effect also in the case where the image forming apparatus does not include a plurality of paper feed ports.

The same paper feed port is highly likely to be refilled with a single type of paper. Performing the identification of the recording material type when the first print job is printed after recording materials are refilled eliminates the need of identification of the recording material type performed for each print job, thus shortening first print time. Moreover, it is possible to save the identification results (the irregularity indication values, reflectivity, transmittance, and the like of the recording material surface) of the plurality of sheets and identify the type of recording materials inside the paper feed port based on the identification results of the plurality of sheets. This case can provide identification accuracy higher than that in the case where the recording material type is determined by the identification performed only for the first recording material. It is possible to set the various types of settings (printing conditions) in the print processing fitted to each recording material as described above so that recording onto the recording materials would be performed under optimal conditions.

Second Embodiment

The basic configuration of the second embodiment is similar to that of the aforementioned first embodiment, except the method of changing the stored type of the recording material, and detailed description thereof is omitted.

In this embodiment, it is detected that the recording material inside a paper feed port has changed. When printing a first print job after the change, the recording material identification unit performs an operation to re-identify recording materials inside the paper feed port, and then the printing conditions are set again, or reviewed, based on the indication result thereof. Moreover, the identification result is stored and is utilized when a following print job is printed.

The change of recording materials inside the paper feed port can be detected by monitoring insertion of the cassette. The cassette is often removed and inserted when recording materials are changed or added. The identification of the recording materials performed after the cassette is inserted makes it possible to print under printing conditions proper for the recording materials.

Such re-identification of the recording materials needs to be performed after the image forming apparatus returns from a state where the insertion of the cassette cannot be detected, for example, the power save mode or the power off state. This is because the cassette can be removed and inserted even at the power save mode or in the power off state.

The change of recording materials inside a paper feed port can be also detected by a sensor which detects the presence of recording materials inside the paper feed port and by the recording material presence or absence information detected by the sensor. In this case, the identification results retained in a recording material identification result storage device is initialized when the absence of recording materials is detected. Such a control ensures that the recording material identification is again performed after the refilling of recording materials. It is therefore possible to perform printing onto the refilled recording materials under proper printing conditions.

The change of recording materials inside a paper feed port can be also detected by detecting that a lifter moves a recording material holding plate down to the paper feed position, which plate holds the recording materials inside the paper feed port, or by detecting that paper size has changed. This can produce a similar effect to that of the above description.

Figure 10:
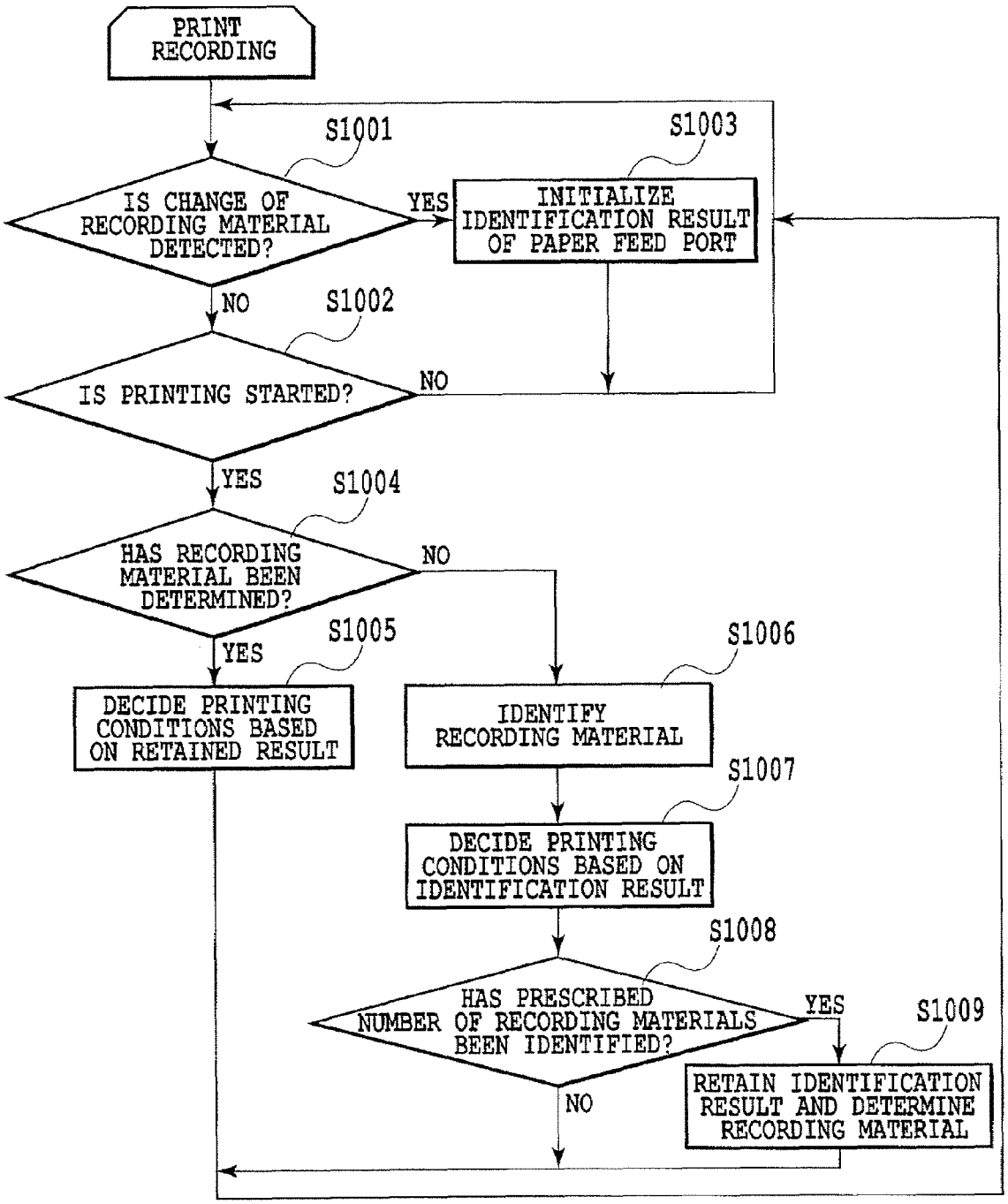
FIG. 10 is a flowchart for explaining control of printing conditions in a second embodiment of the present invention.

Next, a description is given of an operation of this embodiment with reference to FIG. 10. FIG. 10 is a flowchart for explaining a control of printing conditions in the image forming apparatus. This control is started after the image forming apparatus is powered on and initial settings of the image forming apparatus are completed. Before printing is started, the CPU 501 checks whether recording materials in a specified paper feed port has changed (S1001). When detecting that the recording materials have changed, the CPU 501 initializes the identification results of the paper feed port (S1003). The CPU 501 repeats this operation until printing is started (S1002).

When the printing is started, it is checked whether the determined value is retained as the recording material indication result for the paper feed port (S1004). Herein, in a case where the determined value of the recording material identification results is stored, the printing conditions are decided using the stored determined value of the recording material identification results without performing the recording material identification on the recording materials (S1005), and the processing returns to S1001. In a case where the determined value of the recording material identification results is not retained, the recording material identification is performed on a recording material of interest. The obtained result is then stored (S1006), and the printing conditions are decided by the obtained identification result (S1007). Subsequently, it is checked whether the recording material identification results of the prescribed number of sheets are stored (S1008). In a case where the recording material identification results of such number are stored, the identification result is determined (S1009) and retained. In a case where the recording material identification results of such number are not stored, this processing returns to S1001. In S1008, the identification result stored in S1006 is examined. Details of S1004 to S1009 are the same as those of S901 to S906 of FIG. 9.

In this embodiment, it is monitored whether a new recording material is inserted by the user while the image forming apparatus is in operation. This embodiment is characterized in that upon reception of a signal indicating the possibility that a new recording material is inserted, the previous identification results or determined value which are stored corresponding to the paper feed port of interest, and which have been used until then, are initialized (erased).

Third Embodiment

This embodiment is a mode obtained in a case where the aforementioned second embodiment is applied to an image forming apparatus including a so-called multi-tray. FIG. 14 shows an image forming apparatus including a multi-tray 300. The recording material P set in the multi-tray 300 is fed by a multi-tray paper feed roller 301 and is led to the convey roller 225. The multi-tray 300 is a tray in which various types (various sizes) of recording materials can be loaded according to user's intended use.

In an image processing apparatus such as a copier, a printer, and a facsimile, it is required that various types of recording materials can be used. There has been an increasing demand especially for thick paper and special paper such as high glossy paper, label paper, and OHT, among the various types of recording materials. Many image processing apparatuses include a recording material accommodating section called a multi-tray as means for feeding such recording materials. The multi-tray, generally, has an advantage that various types of recording materials can be easily set at a paper feed port without opening or closing the tray when various types of recording materials are intermittently printed according to user's intended use. In the multi-tray, therefore, it is difficult to detect a change of recording materials by the method shown in the second embodiment, and paper is often topped up as the purpose of use of the multi-tray suggests. Accordingly, even if identification information of recording materials is stored and retained, the identification information is likely to be different from that of recording materials at printing. This embodiment, therefore, employs the following method. In the case of a paper feed port where change of the recording materials can be detected, for example, a body cassette or the like, the identification results of the recording material type are stored and saved, and at the subsequent job, the printing conditions are decided based on the stored identification results without performing the identification of the recording material type. However, in the case of a paper feed port where it is difficult to detect the change of recording materials, for example, the multi-tray or the like, the identification results of the recording material type are not stored and saved, and the operation to identify recording materials is performed for each print job, and the printing conditions are decided by the obtained identification results. Other than the method in which the identification operation is performed for each print job, the identification operation may be performed for every recording material independently of print jobs.

Figure 11:
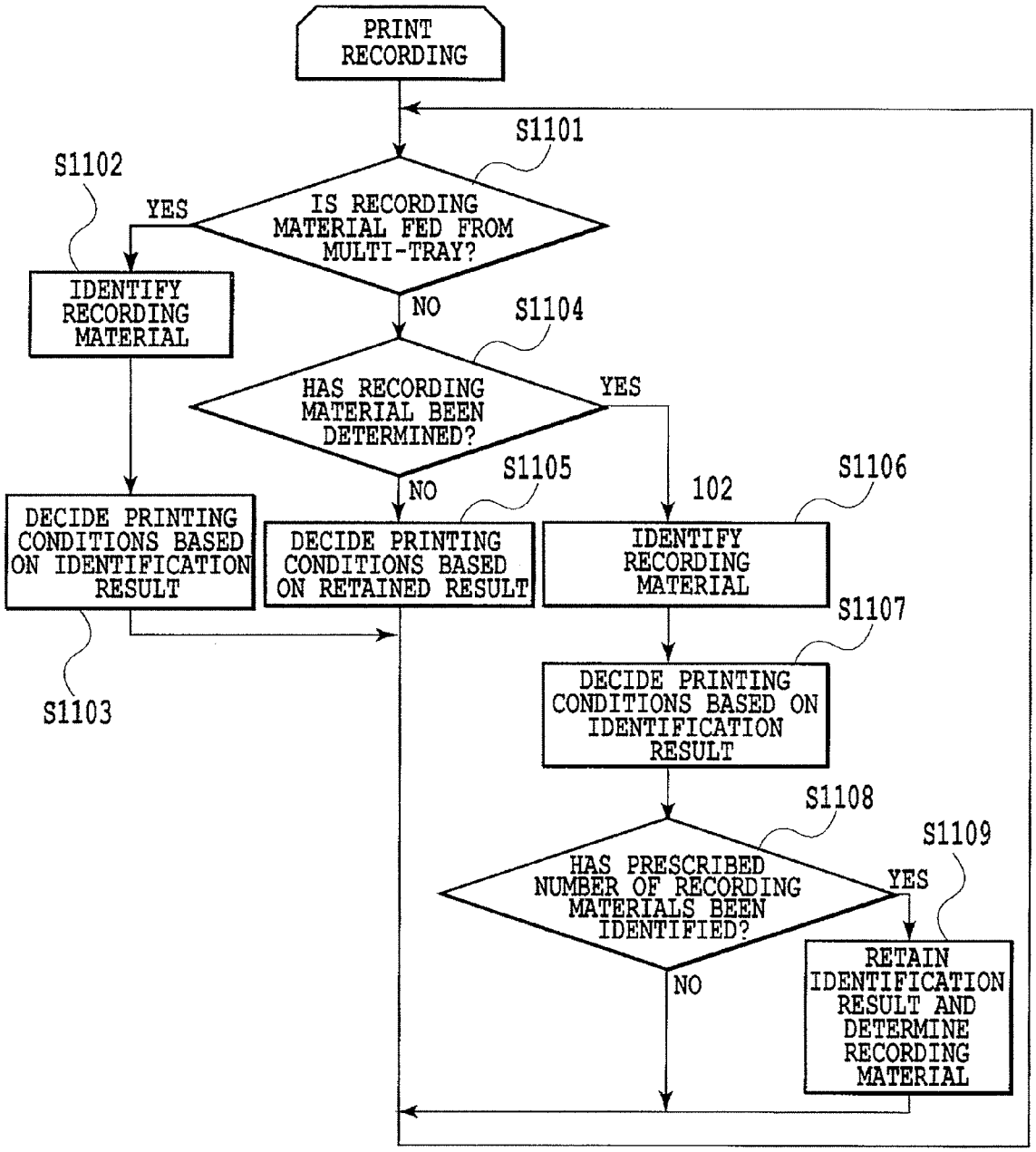
FIG. 11 is a flowchart for explaining control of printing conditions in a third embodiment of the present invention.

A description is given of an operation of this embodiment using FIG. 11. The basic configuration of the third embodiment is the same as that of the aforementioned embodiment except that the identification results of recording materials are not stored nor retained, and the detailed description thereof is omitted.

After printing is started, the CPU 501 checks whether change of recording materials at a specified paper feed port is detectable (S1101). When the change of recording materials at the specified paper feed port is undetectable, for example in the case of the multi-tray, the recording material identification is performed on the recording materials (S1102), and the printing conditions are decided by the obtained identification results (S1103) When the change of recording materials at the specified paper feed port is detectable, the CPU 501 checks whether the recording material identification result for the paper feed port is retained (S1104). In a case where the recording material identification result is saved, the recording material identification is not performed on the recording materials of interest, and the printing conditions are decided using the saved recording material identification result (S1105). In a case where the recording material identification result is not retained, the recording material identification is performed on the recording material (S1106), and the printing conditions are decided by the obtained identification result (S1107). Subsequently, the CPU 501 checks whether recording material identification results for the prescribed number of sheets are stored (S1108). When the recording material identification results are saved, the identification results are determined (S1109) and retained.

As described above, by employing different ways of setting the printing conditions for recording materials for different paper feed ports, more specifically, by employing different ways of operation in the recording material identification and in the application of the identification result to the printing conditions, the operation to identify recording materials can be optimized. This can minimize a disadvantage to the user.

In the above description, the identification result on each recording material and the determined values determined from these identification results are stored in a storage device accessible by the CPU 501. The storing operation is performed for each paper feed port, to be more precise, for each paper feed port in which the identification is performed on the first predetermined number of sheets makes it possible to omit the identification performed on the subsequent recording materials. This storage device can be volatile or nonvolatile. In the case of a volatile storage, the identification result and the determined value are erased at initialization after the image forming apparatus is powered on, and the recording material identification is performed at first printing. In the case of a nonvolatile storage, the identification result and the determined value are initialized at the initialization after the image forming apparatus is powered on.

Moreover, it will be understood by those skilled in the art that the aforementioned conditions to obtain the determined value can be set according to user's usage of the image forming apparatus. For example, suppose a case of a user who satisfies the assumed condition by the present invention though the recording material is frequently changed. Such a user can reduce the prescribed number of sheets necessary to obtain the determined value as long as a predetermined degree of accuracy is obtainable in the identification of the recording materials which are of limited number of types and which show a small variation in identification, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-221589, filed Jul. 29, 2005, which is hereby incorporated by reference herein in its entirety.

What is claimed is:

1. An image forming apparatus, comprising:

a feed section adapted to feed a recording material from a recording material accommodating section;

a detecting section adapted to detect a type of a plurality of the recording materials fed from the feed section; and a controller adapted to determine the type of the recording materials based on the result of the detection of the type of the plurality of recording materials, wherein the controller controls to determine the type of the recording materials based on the result of the detection of first supplied recording materials from the feed section until detecting a prescribed number of sheets of recording material by the detecting section, and after detecting a prescribed number of sheets of recording material by the detection section, controls to determine the type of the recording materials based on a detecting result of the prescribed number of sheets and controls to stop the detecting operation of the detecting section.

2. The image forming apparatus according to claim 1, further comprising a storage device adapted to store the detecting result of the prescribed number of sheets by the controller, wherein the controller makes a control to cause the detecting section not to perform the detection on the recording material in a case where the determination result is stored in the storage section at the start of a printing operation.

3. The image forming apparatus according to claim 2, further comprising a recording material change detecting section for detecting addition and replacement of recording materials in the recording material accommodating section, wherein the storage device is initialized when the recording material change detecting section detects the addition or replacement of the recording materials.

4. The image forming apparatus according to claim 2, wherein the recording material accommodating section includes: a recording material loading section which can move up and down; and a lifter which lifts and lowers the recording material loading section, the image forming apparatus further comprising a lifter detecting section the output of which changes according to a position where the lifter means is stopped, wherein the storage device is initialized in a case where a change of the recording material is detected by detecting a change in the position of the lifter based on the result of the detection by the lifter detecting section.

5. The image forming apparatus according to claim 2, wherein the paper feed section includes, inside the recording material accommodating section, a recording material presence detecting section the output of which changes depending on whether the recording material is present or absent, and the storage device is initialized based on the result of the detection by the recording material presence detecting section.

6. The image forming apparatus according to claim 2, further comprising a recording material size detecting section which detects the size of the recording material accommodated in the recording material accommodating section, wherein the storage device is initialized in a case where a change of the recording material is detected based on the result of the detection by the recording material size detecting section.

7. The image forming apparatus according to claim 2, wherein the recording material accommodating section is adapted to be attachable to and detachable from the image forming apparatus, the image forming apparatus further comprising a removal and insertion detecting section which detects removal and insertion of the recording material accommodating section, and the storage device is initialized based on the result of the detection by the removal and insertion detecting section.

* * * * *